US005702539A

United States Patent [19]

Schoen et al.

[11] Patent Number: 5,702,539

[45] Date of Patent: Dec. 30, 1997

[54] METHOD FOR PRODUCING SILICON-CHROMIUM GRAIN ORIETED ELECTRICAL STEEL

[75] Inventors: Jerry W. Schoen, Middletown; Norris A. Dahlstrom, Hamilton, both of Ohio; Christopher G. Klapheke, Gibsonia, Pa.

[73] Assignee: Armco Inc., Middletown, Ohio

[21] Appl. No.: 808,894

[22] Filed: Feb. 28, 1997

[51] Int. Cl.[6] ..... H01F 1/04

[52] U.S. Cl. ..... 148/111; 148/112; 148/113

[58] Field of Search ..... 148/110, 111, 148/112, 113

[56] References Cited

U.S. PATENT DOCUMENTS

| | | | |
|---|---|---|---|
| 3,947,296 | 3/1976 | Kumazawa | 148/111 |
| 5,061,326 | 10/1991 | Schoen . | |
| 5,288,736 | 2/1994 | Schoen et al. | 148/111 |
| 5,421,911 | 6/1995 | Schoen | 148/111 |

*Primary Examiner*—John Sheehan

*Attorney, Agent, or Firm*—R. J. Bunyard; L. A. Fillnow

[57] ABSTRACT

The present invention provides a method of producing grain oriented electrical steel having excellent mechanical and magnetic properties. A hot processed strip having a thickness of 1.5–4.0 mm thickness a composition consisting essentially of 2.5–4.5% silicon, 0.1–1.2% chromium, less than 0.050% carbon, less than 0.005% aluminum, up to 0.1% sulfur, up to 0.14% selenium, 0.01–1% manganese and balance being essentially iron and residual elements, all percentages by weight. The strip has a volume resistivity of at least 45 μΩ-cm, at least 0.010% carbon so that an austenite volume fraction ($\gamma_{1150°}$ C.) of at least 2.5% is present in the hot processed strip and each surface of the strip has an isomorphic layer having a thickness of at least 10% of the total thickness of the hot processed strip. The strip is cold reduced to an intermediate thickness, annealed, cold reduced to a final thickness and decarburized to less than 0.003% carbon. The decarburized strip then is coated on at least one surface with an annealing separator and final annealed to effect secondary grain growth. The electrical steel has a permeability measured at 796 A/m of at least 1780.

20 Claims, 2 Drawing Sheets

METHOD FOR PRODUCING SILICON-CHROMIUM GRAIN ORIETED ELECTRICAL STEEL

BACKGROUND OF THE INVENTION

The present invention relates a method of producing grain oriented electrical steel from a hot processed strip using at least two cold reductions. More specifically, the hot processed strip contains 2.5–4.5% silicon, 0.1–1.2% chromium, less than 0.050% carbon, less than 0.005% aluminum, has a volume resistivity of at least 45 μΩ-cm, at least 0.010% carbon so that an austenite volume fraction (γ1150° C.) of at least 2.5% is present in the strip and that each surface of the strip has an isomorphic layer having a thickness of at least 10% of the total thickness of the strip.

Electrical steels are broadly characterized into two classes. Non-oriented electrical steels are engineered to provide a sheet characterized with magnetic properties nearly uniform in all directions. These steels are comprised of iron, silicon and/or aluminum to impart higher specific electrical resistivity to the steel sheet and thereby lower core loss. Non-oriented electrical steels may also contain manganese, phosphorus and other elements commonly known in the art to provide higher volume resistivity which lowers core losses created during magnetization.

Grain oriented electrical steels are engineered to provide a sheet with high volume resistivity and having highly directional magnetic properties owing to the development of a preferential grain orientation. Grain oriented electrical steels are further differentiated by the level of magnetic properties developed, the grain growth inhibitors used and the processing steps which provide the desired magnetic properties. Regular (conventional) grain oriented electrical steels contain silicon to provide higher volume resistivity and have a magnetic permeability measured at 796 A/m of at least 1780. High permeability grain oriented electrical steels contain silicon to provide higher volume resistivity and have a magnetic permeability measured at 796 A/m of at least 1880. The volume resistivity of commercially produced silicon-bearing grain oriented electrical steels ranges from 45 to 50 μΩ-cm, containing from 2.95% to 3.45% silicon with iron and other impurities incidental to the method of melting and steelmaking employed. It also is known that the use of increased silicon also requires more carbon to maintain a small, but necessary, amount of austenite during processing. However, these changes in composition result in a strip with poorer mechanical properties and increased physical difficulties during processing due to greater brittleness caused by the higher silicon and carbon levels.

Regular grain oriented electrical steels also typically contain additions of manganese and sulfur (and possibly selenium) as the principal grain growth inhibitors. Other elements such as aluminum, antimony, boron, copper, nitrogen and the like are sometimes present and may supplement the manganese sulfide/selenide inhibitors to provide grain growth inhibition.

Regular grain oriented electrical steel may have a mill glass film, commonly called forsterite, or an insulative coating, commonly called a secondary coating, applied over or in place of the mill glass film, or may have a secondary coating designed for punching operations where laminations free of mill glass coating are desired in order to avoid excessive die wear. Generally, magnesium oxide is applied onto the surface of the steel prior to a high temperature final anneal. This primarily serves as an annealing separator coating; however, these coatings may also influence the development and stability of secondary grain growth during the final high temperature anneal and react to form the forsterite (or mill glass) coating on the steel and effect desulfurization of the steel during annealing.

To obtain a high degree of cube-on-edge orientation, the material must have a structure of recrystallized grains with the desired orientation prior to the high temperature portion of the final anneal and must have a grain growth inhibitor to restrain primary grain growth in the final anneal until secondary grain growth occurs. Of great importance in the development of the magnetic properties of electrical steel is the vigor and completeness of secondary grain growth. This depends on two factors. First, a fine dispersion of manganese sulfide (or other) inhibitor particles capable of restraining primary grain growth in the temperature range of 535°–925° C. is needed. Second, the grain structure and texture of the steel and of the surface and near-surface layers of the steel must provide conditions appropriate for secondary grain growth. The near-surface layer describes the region of the steel surface which has been depleted of carbon and provides a single phase or isomorphic ferrite microstructure. This region has been referred to in the art as the surface decarburized layer and the like or, in an alternative form, is defined by the boundary between the isomorphic surface layer and the polymorphic (mixed phases of ferrite and austenite or its decomposition products) interior layers, such as the shear band and the like. The role of the isomorphic layer has been reported in numerous technical publications which show that cube-on-edge secondary grain nuclei with the highest likelihood of sustaining vigorous growth and providing a high degree of cube-on-edge grain orientation in the finally annealed grain oriented electrical steel are located within the isomorphic layers or, alternatively, near the boundary between the isomorphic surface layer and polymorphic sheet interior layer. The cube-on-edge nuclei which have sufficiently favorable conditions to initiate secondary grain growth consume the less perfectly oriented matrix of primary grains.

Regular grain oriented electrical steel is generally produced using one or more cold reductions in order to achieve the desired magnetic properties. A representative process for producing regular grain oriented electrical steel using two stages of cold reduction is taught in U.S. Pat. No. 5,061,326, incorporated herein by reference. U.S. Pat. No. 5,061,326 discloses using higher levels of silicon to improve the core losses of grain oriented electrical steels. Such additions contributed to poorer physical properties and greater difficulties in processing, principally resulting from a increase in the brittleness of the material.

It also has been desired to produce grain oriented electrical steel using a single cold reduction with low core loss made by increasing the volume resistivity of the steel. U.S. Pat. No. 5,421,911, incorporated herein by reference, discloses chromium can be a useful addition to an oriented electrical steel made using a single cold reduction provided other process requirements are satisfied, including a composition providing levels of uncombined manganese and tin of 0.030% or less, an anneal of the starting strip, a carbon level of 0.025% or more after annealing and prior to cold rolling, an austenite volume fraction (γ1150° C.) in excess of 7% after annealing and prior to cold rolling, and use of a sulfur-bearing annealing separator coating.

Accordingly, there has been a long felt need for controlling the alloy composition and processing to provide a grain growth inhibitor and an appropriate microstructure and texture essential to producing grain oriented electrical steels having uniform and consistent magnetic properties. There has also been a long felt need for providing a grain oriented electrical steel having a high degree of cube-on-edge orientation and a high level of volume resistivity using large chromium additions in place of or in addition to silicon in a grain oriented electrical steel. There has also been a long felt need for providing a grain oriented electrical steel having stable secondary grain growth.

BRIEF SUMMARY OF THE INVENTION

A principal object of the invention is to provide a grain oriented electrical steel having a composition including silicon, chromium and a suitable inhibitor which is processed using at least two cold reductions which result in the steel having improved magnetic properties.

Another object of the invention is to provide a grain oriented electrical steel having a composition including silicon, chromium and a suitable inhibitor which has at least two cold reductions for producing uniform and consistent magnetic properties.

Another object of the invention is to provide a grain oriented electrical steel having a composition including silicon, chromium and a suitable inhibitor, at least two cold reductions, a high degree of cube-on-edge orientation and a high level of volume resistivity using large chromium additions in place of or in addition to silicon in a grain oriented electrical steel.

Another object of the invention is to provide a grain oriented electrical steel having a composition including silicon, chromium and a suitable inhibitor, at least two cold reductions and a microstructure and texture essential to producing grain oriented electrical steels having uniform and consistent magnetic properties.

The present invention provides a method of producing grain oriented electrical steel having excellent mechanical and magnetic properties and being characterized as having permeabilities measured at 796 A/m of at least 1780. A hot processed strip is provided having a composition consisting essentially of 2.5–4.5% silicon, 0.1–1.2% chromium, less than 0.050% carbon, less than 0.005% aluminum, up to 0.1% sulfur, up to 0.14% selenium, 0.01–1% manganese and balance being essentially iron and residual elements, all percentages by weight. The strip has a volume resistivity of at least 45 μΩ-cm, at least 0.010% carbon so that an austenite volume fraction (γ1150° C.) of at least 2.5% is present in the hot processed strip and each surface of the strip has an isomorphic layer having a thickness of at least 10% of the total thickness of the hot processed strip. The strip is cold reduced to an intermediate thickness, annealed, cold reduced to a final thickness and decarburized so that the strip will not magnetically age. The decarburized strip then is coated on at least one surface with an annealing separator coating and final annealed to effect secondary grain growth. The electrical steel has a permeability measured at 796 A/m of at least 1780.

Another feature of the invention is for the aforesaid isomorphic layer on each surface to have a thickness of 15–40% of the total thickness of the hot processed strip.

Another feature of the invention is for the aforesaid strip before cold rolling to the intermediate thickness being annealed at a temperature of 750–1150° C. and slowly cooled thereafter to less than 650° C.

Another feature of the invention is for the aforesaid annealed strip before the cold rolling to final thickness having at least 0.010% carbon.

Another feature of the invention is for the carbon in the aforesaid annealed strip before the cold rolling to final thickness being no greater than 0.03%.

Another feature of the invention is for the aforesaid chromium being 0.2–0.6%.

Another feature of the invention is for the aforesaid strip being annealed before cold rolling to the final strip thickness at a temperature of at least 800° C.

Another feature of the invention is for the aforesaid strip being final annealed at a temperature of at least 1100° C.

Another feature of the invention is for the aforesaid hot processed strip having a thickness of 1.7–3.0 mm.

An advantage of the invention includes a chromium-silicon grain oriented electrical steel having a very high volume resistivity without degrading the physical properties and processability heretofore associated with the prior art high silicon grain oriented electrical steels. Another advantage is being able to produce an electrical steel having a volume resistivity of about 50 μΩ-cm. Another advantage is an electrical steel having improved mechanical property characteristics that provide superior toughness and greater resistance to strip breakage during processing. Another advantage is an electrical steel having silicon, manganese, sulfur and/or selenium thereby easing dissolution of the sulfides or selenides during reheating prior to hot processing.

The above and other objects, features and advantages of the invention will become apparent upon consideration of the detailed description and appended drawings.

DESCRIPTION OF THE PREFERRED EMBODIMENT

Figure 1:
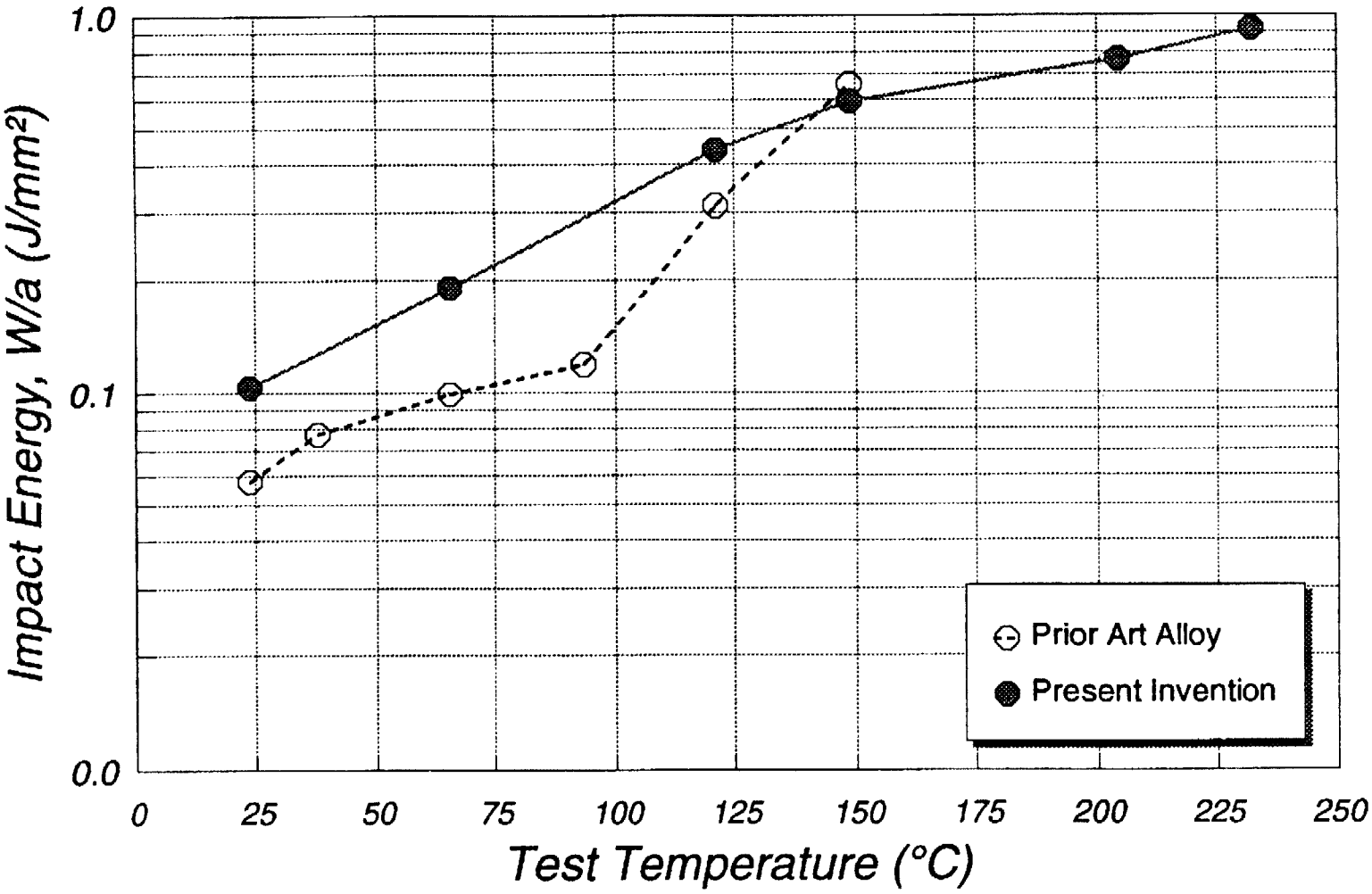
FIG. 1 is a graph illustrating a comparison of the impact toughness and ductile-to-brittle transformation characteristics of a starting hot processed strip for a prior art silicon alloyed grain oriented electrical steel and a chromium-silicon alloyed grain oriented electrical steel of the present invention having a volume resistivity of about 50–51 μΩ-cm.
Figure 2:
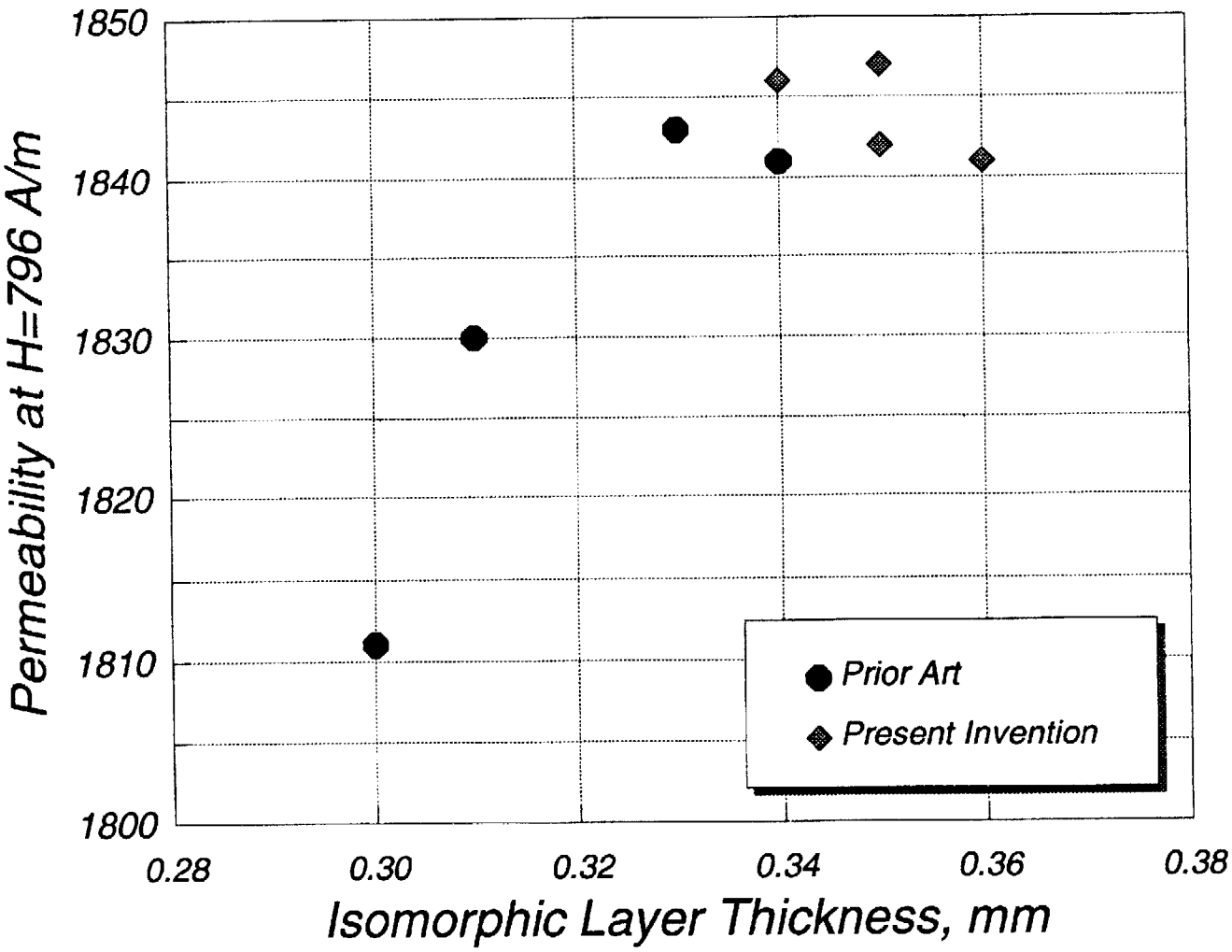
FIG. 2 is a graph illustrating a comparison of the effect of the isomorphic layer thickness, measured on a hot processed annealed strip prior to cold rolling to intermediate thickness, on the magnetic permeability measured at H=796 A/m of a prior an silicon alloyed grain oriented electrical steel and a silicon-chromium alloyed grain oriented electrical steel of the present invention.

The present invention provides a method of producing grain oriented electrical steel having excellent mechanical and magnetic properties. A hot processed strip having a thickness of about 1.5–4.0 mm is provided having a composition consisting essentially of 2.5–4.5% silicon, 0.1–1.2% chromium, less than 0.050% carbon, less than 0.005% aluminum, up to 0.1% sulfur, up to 0.14% selenium, 0.01–1% manganese and balance being essentially iron and residual elements. All discussion in the present patent application relating to alloy composition percentages (%) are in terms of weight (wt. %) unless otherwise noted. The hot processed strip has a volume resistivity of at least 45 μΩ-cm, at least 0.010% carbon so that an austenite volume fraction (γ1150° C.) prior to cold reduction is at least 2.5% present in the hot processed strip and each surface of the hot processed strip has an isomorphic layer having a thickness of at least 10% of the total thickness of the hot processed strip. The hot processed strip is cold reduced to an intermediate thickness, annealed, cold reduced to a final thickness final strip thickness preferably of 0. 15–0.50 mm and decarburized to less than 0.003% carbon. The decarburized strip then is coated on at least one surface with an annealing separator coating and final annealed to effect secondary grain growth. The electrical steel has a permeability measured at 796 A/m of at least 1780. The steel is decarburized to less than 0.003% carbon so that the strip after final annealing will not magnetically age. The chromium-silicon grain oriented electrical steel of this invention provides high volume resistivity, very stable secondary grain growth, excellent magnetic properties and improved mechanical property characteristics that provide superior toughness and greater resistance to strip breakage during processing.

The starting steel of the invention is made from hot processed strip. By "hot processed strip", it will be understood to mean a continuous length of strip produced using methods such as ingot casting, thick slab casting, thin slab casting, strip casting or other methods of compact strip production using a melt composition containing iron, silicon, chromium and a suitable inhibitor.

Grain oriented electrical steels have traditionally been ternary carbon-silicon-iron compositions which attempted to limit the compositions of manganese, sulfur, chromium, nitrogen and titanium because of their influence on the magnetic quality of materials so produced. The discovery of the present invention was the result of studies of the effect of carbon, silicon and chromium on the microstructural characteristics of steel strip allowing successful production of a chromium-silicon regular grain oriented electrical steel. The present invention provides a method of producing grain oriented electrical steel having a high quality cube-on-edge orientation and a volume resistivity in excess of 45 μΩ-cm and, thereby, low core losses using less than 0.005% aluminum and at least two cold reductions. Equation 1 illustrates the effects of various additions to iron on the volume resistivity (ρ) of the alloy as:

$$\rho=13+6.25(\%Mn)+10.52(\%Si)+11.82(\%Al)+6.5(\%Cr)+14(\%P), \quad (1)$$

wherein ρ is the volume resistivity of the alloy in units of μΩ-cm and Mn, Si, Al, Cr and P are the percentages of manganese, silicon, aluminum, chromium and phosphorus respectively comprising the chemistry of the grain oriented electrical steel. The volume resistivity of commercially produced oriented silicon-iron electrical steels ranges from 45 to 51 μΩ-cm, which contain from 2.95–3.45% silicon and other impurities incidental to the method of melting and steelmaking. While higher volume resistivity materials have long been desired, the methods of the prior art typically rely on increasing the percentage of silicon in the alloy. As has been shown in the art, increasing the percentage of silicon typically requires a corresponding increase in the percentage of carbon. Higher percentages of silicon and carbon are well known to contribute to poorer physical properties in electrical steels, principally resulting from an increase in brittleness and increased difficulty in completely removing carbon during the decarburization annealing step. It was determined that increasing the percentage of silicon and carbon also is harmful to the microstructural characteristics needed for vigorous secondary grain growth. An important feature of the present invention is that the composition of silicon and carbon alter the thickness of the surface isomorphic layer provided in the strip before cold reduction.

In prior methods of making grain oriented electrical steels using two or more cold reductions, chromium was found to interfere with the development of the desired cube-on-edge texture. In the present invention, it was determined that chromium also causes a similar thinning of the isomorphic layer owing to its effect on austenite formation and its effect on carbon losses during processing. This heretofore unrecognized change was found to adversely affect the stability and vigor of secondary grain growth.

Unstable secondary grain growth is a problem which has troubled the producers of grain oriented silicon steel for a number of reasons, including, but not limited to the quality of the grain growth inhibitor, the quality of the microstructure of the starting strip or other elements in the alloy composition pertinent to a particular method. For example, the percentage of excess manganese not combined with sulfur and/or the amount of austenite contribute strongly to the stability of secondary grain growth using a single cold reduction process disclosed in U.S. Pat. No. 5,421,911. An important feature of the present invention is that the stability of secondary grain growth and the development of the desired cube-on-edge texture has been related to the thickness of the surface isomorphic layer and the amount of austenite provided prior to cold reduction.

A preferred composition of the present invention includes 2.9–3.8% silicon, 0.2–0.7% chromium, 0.015–0.030% carbon, less than 0.0005% aluminum less than 0.010% nitrogen, 0.05–0.07% manganese, 0.020–0.030% sulfur, 0.015–0.05% selenium and less than 0.06% tin. A more preferred composition includes 3.1–3.5% silicon. Silicon is primarily added to improve the core loss by providing higher volume resistivity. In addition, silicon promotes the formation and/or stabilization of ferrite and, as such, is one of the major elements affecting the volume fraction (γ1150° C.) of austenite. While higher silicon is desired to improve the magnetic quality, its effect must be considered in order to maintain the desired phase balance, microstructural characteristics and mechanical properties.

Grain oriented electrical steel of the present invention may have chromium contents ranging from 0.10–1.2%, preferably 0.2 to 0.7% and more preferably 0.3–0.5%. Chromium is added primarily to improve the core loss by providing higher volume resistivity. At compositions less than 1.2%, chromium promotes the formation and stabilization of austenite and affects the volume fraction ($\gamma_{1150° C.}$) of austenite. Higher amounts of chromium adversely affect the ease of decarburization. While higher chromium is desired to improve the magnetic quality, its effect must be considered in order to maintain the desired phase balance and microstructural characteristics.

Grain oriented electrical steel of the present invention contains carbon and/or additions such as copper, nickel and the like which promote and/or stabilize austenite, are employed to maintain the phase balance during processing. The mount of carbon present in the hot processed strip is sufficient to provide a starting strip, i.e., prior to cold rolling, with 0.010–0.050% carbon, preferably 0.015–0.030% and more preferably 0.015–0.025%. Low percentages of carbon less than 0.010% immediately prior to the cold reduction to the intermediate thickness are undesirable because secondary re, crystallization becomes unstable and the quality of the cube-on-edge orientation of the product is impaired. High percentages of carbon above 0.050% are undesirable because they result in thinning of the isomorphic layer which weakens secondary grain growth and provides a lower quality cube-on-edge orientation, and increases the difficulty in obtaining carbon less than 0.003% in the final cold rolled strip to prevent magnetic aging.

Prior to the development of the present invention, carbon losses of up to 0.010% were observed after the hot processed strip was annealed prior to cold reduction to the intermediate thickness, typically at 1025°–1050° C. in a oxidizing atmosphere for 15–30 seconds and, in many cases, the carbon loss during the anneal was essential to develop an appropriately thick isomorphic layer. However, excessive carbon removal during an anneal prior to a cold reduction to an intermediate strip thickness may result in an improper phase balance and microstructure and necessitate raising the carbon composition in the hot processed strip to compensate for these losses in subsequent processing. In the present invention, the amount of carbon needed to be removed during decarburization annealing is greatly reduced.

Manganese is present in the steels of the present invention in an amount of 0.01–0.15%, preferably of 0.04–0.08% and more preferably 0.05–0.07%. If conventional methods of steel melting and casting wherein either ingots or continuously east slabs are used to produce a starting strip for processing in accordance with the present invention, a lower percentage of excess manganese, i.e., manganese uncombined as manganese sulfide or manganese selenide, is advantageous to ease dissolution of manganese sulfide during slab reheating prior to hot wiling.

Sulfur and selenium are added in the melt to combine with manganese to form the manganese sulfide and/or manganese selenide precipitates needed for primary grain growth inhibition. Sulfur, if used alone, will be present in amounts of from 0.006–0.06% and, preferably, of from 0.020–0.030%. Selenium, if used alone, will be present in amounts of from 0.010–0.14% and, preferably, of from 0.015–0.05%. Combinations of sulfur and selenium may be used.

Acid soluble aluminum is maintained less than 0.005% and preferably less than 0.0015% in the steels of the present invention in order to provide stable secondary grain growth. While aluminum is helpful to control the amount of dissolved oxygen in the steel melt, the percentage of soluble aluminum must be maintained less than the upper limit.

The steel may also include other elements such as antimony, arsenic, bismuth, copper, molybdenum, nickel, phosphorus and the like made either as deliberate additions or present as residual elements, i.e., impurities from steelmaking process. These elements can affect the austenite volume fraction (γ1150° C.) and/or the stability of secondary grain growth.

It was discovered in the present invention that amounts of silicon, chromium and a suitable inhibitor along with other elements incidental to the method of steelmaking must be specified in order to obtain an appropriately thick isomorphic layer while providing a small, but necessary mount of austenite in the starting strip prior to cold reduction. Equation (2) below is an expanded form of an equation originally published by Sadayori et al. in their publication, "Developments of Grain Oriented Si-Steel Sheets with Low Iron Loss", *Kawasaki Seitetsu Giho*, vol. 21, no. 3, pp. 93–98, 1989, to calculate the austenite volume fraction (γ1150° C.) of iron containing 3.0–3.6% silicon and 0.030–0.065% carbon at a temperature of 1150° C. Equation (2) has been expanded based on the present research to calculate the austenite volume fraction at 1150° C as:

$$\gamma 1150^\circ\ C. = 64.8 - 23(\%Si) + 5.06(\%Cr + \%Ni + \%Cu) + 694(\%C) + 347(\%N). \quad (2)$$

While silicon and carbon are the primary elements of concern, other elements such as chromium, nickel, copper, tin, phosphorus and the like, made as deliberate additions or present as impurities from the steelmaking process will also affect the amount of austenite and, if present in significant amounts, must be considered. In the present invention, the thickness of the isomorphic layer and the austenite volume fraction have been found to be functions of the composition of the starting hot processed strip, changes in the carbon content incurred in converting the steel melt into the starting hot processed strip, the thickness (t) of the hot processed strip and changes in the carbon content to the hot processed strip if the strip is annealed prior to cold rolling to the intermediate thickness. The change in the carbon content incurred in converting the steel melt into the starting hot processed strip has been found to be:

$$C_1 = \frac{0.231(\%\ C_{melt})}{t^2} \quad (3)$$

where $C_{melt}$ is the weight percentage of carbon provided in the steel melt, $C_1$ is the weight percentage of carbon lost in the conversion of the steel melt into a hot processed strip and t is the thickness of the hot processed strip in mm. If the hot processed strip is annealed prior to cold rolling to an intermediate strip thickness, additional carbon loss may occur which must be considered as:

$$C_2 = 1/t^2[0.413(\%C_{melt} - C_1) - 0.153(\%Cr)] \quad (4)$$

where $C_2$ is the weight percentage of carbon lost in annealing the hot processed strip and %Cr is the weight percentage of chromium provided in the alloy. Given that the mount of carbon is dependent on the thickness (t) of the hot processed strip, the chromium content provided and the thickness of the hot processed strip, it is readily apparent to one skilled in the art that these compositions must be judiciously selected. It is implicit in the teachings of the present invention that the carbon composition of the steel strip prior to cold rolling to the intermediate thickness must be sufficient to provide the desired percentage of austenite necessary for the development of stable and consistent secondary grain growth. The carbon composition prior to cold rolling ($C_3$) is used in Equation (2), that is:

$$C_3 = \%C_{melt} - C_1 - C_2 \quad (5)$$

Combining the factors from the above, the surface isomorphic layer can be calculated using Equation (6):

$$I = 1/t^2\ [5.38 - 4.47\times10^{-2}\gamma 1150^\circ\ C. + 1.19(\%Si)] \quad (6)$$

where I is the calculated isomorphic layer thickness in mm, γ1150° C. is the calculated volume fraction of austenite in the strip prior to cold rolling to the intermediate thickness and %Si is the weight percent of silicon contained in the alloy. The thickness of the isomorphic layer on each surface of the hot processed strip prior to cold reduction to the intermediate thickness should be at least 10% of the total thickness of the hot processed strip. Preferably, the thickness of each isomorphic layer should be 10–40%, more preferably 15–35% and most preferably 20–25%. For a hot processed strip having a thickness of 1.5–4.0 mm, the minimum thickness of the isomorphic layer on each surface of the hot processed strip prior to cold reduction to the intermediate thickness would be about 0.15 mm.

The grain oriented electrical steel of the present invention may provide additional benefits or may require other processing adjustments. The present invention can provide a grain oriented electrical steel sheet with high volume resistivity, improved toughness as illustrated in FIG. 1 and reduced sensitivity to temperature during processing, and improved solidification characteristics during ingot, strand or strip casting owing to improved castability of the steel melt.

The regular grain oriented electrical steel of the present invention can be produced from hot processed strip made by a number of methods. The strip can be produced from ingots, slabs produced from ingots or continuous cast slabs which are reheated to 1260°–1400° C. of followed by hot rolling to provide a starting hot processed strip of 1.5–4.0 mm thickness. The present invention also is applicable to strip produced by methods wherein continuous cast slabs or slabs produced from ingots are fed without significant heating, or without significant heating, or ingots are hot reduced into slabs of sufficient temperature to hot roll to strip with or without further heating, or the molten metal is cast directly into a strip suitable for further processing. In some instances, equipment capabilities may be inadequate to provide the appropriate starting strip thickness needed for the present invention; however, a small cold reduction of 30% or less may be employed prior to the strip anneal or the strip may be hot reduced by up to 50% or more to an appropriate thickness.

When equipment and conditions permit, the starting hot processed strip preferably is annealed at 750°–1150° C. for a time of up to 10 minutes and more preferably at 1025–1100° C. for 10–30 seconds to provide the desired microstructure prior to the first cold reduction to the intermediate strip thickness. Carbon loss during annealing may require an appropriate adjustment in the melt composition to maintain the desired phase balance after completing the anneal. In the present invention, carbon loss during annealing is affected when percentages of silicon and chromium provided is changed, when the thickness of the starting strip is changed and/or when the oxidizing potential of the annealing atmosphere and the time and temperature of annealing is changed. In the present invention, the annealed strip is subjected to ambient air cooling. The process of cooling after annealing is not critical and it is believed the preferred austenite decomposition reaction would provide carbon saturated ferrite and/or pearlite and that the formation of a high volume fraction of martensite or retained austenite is undesirable. An alternative to air cooling would be to cool the steel slowly, such as would be provided by ambient air cooling, to a temperature less than 650° C. and, more preferably, to a temperature less than 500° C. followed by rapid cooling, such as would be provided by water quenching, to a temperature less than 100° C.

Following cold rolling to an intermediate thickness, the steel strip is subjected to an annealing step preceding any subsequent stage of cold rolling. For example, if the steel is cold reduced three times, an intermediate anneal would be required between each of the first and second cold reductions and the second and third cold reductions. The purpose of this step is to provide a microstructure and texture appropriate to any subsequent cold reduction. Generally, such intermediate anneals are conducted under conditions which recrystallize the cold rolled material, cause the carbon present in the prior austenite to decompose into carbon-saturated ferrite while the cooling process after intermediate annealing is conducted under conditions conducive to accelerated austenite decomposition forming a microstructure of fine iron carbide precipitates in a ferrite matrix having less than 1 vol.% of martensite and/or retained austenite. As such, the intermediate anneal can be conducted over a relatively wide temperature range of 800°–1150° C. for 3 seconds up to 10 minutes. Preferably, the intermediate anneal can be conducted using annealing temperatures in the range of from 900°–1100° C. and more preferably from 915°–950° C. for 5–30 seconds with cooling conducive to desired austenite decomposition reactions. After intermediate annealing, the strip is slowly cooled from the soak temperature, generally above 800° C., preferably 925° C, down to a temperature of about 650° C., preferably to about 550° C. By slow cooling is meant a rate of no greater than 10° C., preferably no greater than 5° C. per second. Thereafter, the strip is rapidly cooled down to about 315° C., at which point the strip can be water quenched to complete the rapid cooling. By rapidly cooling is meant a rate of at least 23° C. per second, preferably at least 50° C. per second.

The amount of cold reduction taken in the first cold reduction to the intermediate strip thickness and second cold reduction to the final strip thickness in the process of the present invention is dependent upon the initial and final strip thicknesses. It has been determined that a wide range of final thicknesses can be produced provided that the proper cold reductions are employed. Regular grain oriented electrical steels have been produced in thicknesses of from 0.18–0.35 mm in the trials using the two cold reductions of the present invention. The reductions required can be determined by experimentation wherein the magnetic properties, particularly the quality of the cube-on-edge orientation, are determined by cold reducing strips of various final thicknesses. Excellent magnetic properties have been achieved at standard product thicknesses of 0.18 mm, 0.21 mm, 0.26 mm and 0.29 mm and 0.35 mm using a hot processed strip of 2.03–2.13 mm thickness and subjected to a first cold reduction to intermediate thicknesses of 0.56 mm, 0.58 mm, 0.61 mm, 0.66 mm and 0.81 mm, respectively. In general, the preferred % reduction in a first cold reduction can be expressed by $\ln(a/b)>0.8$, preferably 3 1.2, where a is the thickness of the hot processed strip and b is the intermediate thickness of the strip. The preferred reduction in the second cold reduction can be expressed by $c^{1/2}\ln(b/c)=0.48$ where c is the final thickness of the strip, all thicknesses in mm.

After the cold reduction to final thickness is completed, the steel is annealed in a mildly oxidizing atmosphere to reduce the carbon to an amount which minimizes magnetic aging, typically less than 0.003%. The temperature of this anneal preferably is at least 800° C., more preferably at least 830° C. and the atmosphere may be wet hydrogen-bearing atmosphere such as pure hydrogen or a mixture of hydrogen and nitrogen. In addition, the decarburization anneal prepares the steel for the formation of a forsterite, or "mill glass", coating in the high temperature final anneal by reaction of the surface oxide skin and the magnesium oxide (MgO) annealing separator coating. In the present invention, it is preferred the silicon and chromium content is appropriate to insure that the decarburized electrical steel strip is completely ferritic prior to the high temperature annealing step wherein the cube-on-edge orientation is finally developed.

The final high temperature anneal is needed to develop the cube-on-edge grain orientation. Typically, the steel is heated to a soak temperature of at least 1100° C. in a wet hydrogen atmosphere. During heating, the (110)[001] nuclei begin the process of secondary grain growth at a temperature of about 850° C. and which is substantially completed by about 1100° C. Typical annealing conditions used in the present invention employed heating rates of less than 80° C. per hour up to 815° C. and further heating at rates of less than 50° C. per hour, and, preferably, 25° C. per hour or lower up to the completion of secondary grain growth. Once secondary grain growth is complete, the heating rate is not as critical and may be increased until the desired soak temperature is attained wherein the material is held for a time of at least 5 hours, preferably at least 20 hours, for removal of the sulfur and/or selenium inhibitors and for removal of other impurities, such as nitrogen.

Example 1

A series of grain oriented electrical steels of the present invention were melted with the compositions shown in Table I. These melts were continuously cast into 200 mm thick slabs, reheated to about 1150° C., rolled to 150 mm thick slabs, reheated to about 1400° C. and hot processed to a strip thickness of 2.03 mm suitable for further processing. The melt compositions provided carbon, silicon and chromium, including a balance of iron and normal residual elements such as boron of 0.0005% of less, molybdenum of 0.06% or less, nickel of 0.15% or less, phosphorus of less than 0.10% or less, and aluminum of 0.005% or less. The hot processed strip of this invention included a volume resistivity (ρ) of about 50 μΩ-cm, an austenite volume fraction ($\gamma^{1150° C.}$) in excess of about 10% and an isomorphic layer thickness (I) for each strip surface in excess of 0.30 mm. The hot processed strips were tested for impact toughness and the temperature sensitivity of the ductile-to-brittle transformation temperature at from 23°–230° C. in accordance with procedures of ASTM E-23 "Standard Test Method for Notched Bar Impact Testing of Metallic Materials" specifications. The properties of these inventive steels are compared in Table I to the properties of prior art electrical steels.

TABLE I

Summary of Compositions of Grain Oriented Electrical Steels

| | ID | Si | C | Cr | Mn | S | Al | N | Sn | excess Mn | excess Mn+ 0.46 Sn | ρ | % γ @CR1 | % C @CR1 | I | I/t |
|---|---|---|---|---|---|---|---|---|---|---|---|---|---|---|---|---|
| Prior | A | 3.41 | 0.032 | 0.05 | 0.059 | 0.022 | 0.0004 | 0.0038 | 0.009 | 0.021 | 0.026 | 50.4 | 5.5% | 0.026 | 0.33 | 16% |
| Art | B | 3.42 | 0.032 | 0.05 | 0.061 | 0.022 | 0.0003 | 0.0040 | 0.008 | 0.023 | 0.027 | 50.3 | 5.4% | 0.026 | 0.33 | 16% |
| | C | 3.38 | 0.029 | 0.06 | 0.061 | 0.022 | 0.0002 | 0.0040 | 0.012 | 0.023 | 0.029 | 50.3 | 4.8% | 0.024 | 0.35 | 17% |
| Alloy of | D | 3.25 | 0.025 | 0.33 | 0.059 | 0.024 | 0.0006 | 0.0039 | 0.004 | 0.018 | 0.020 | 50.2 | 8.7% | 0.024 | 0.34 | 17% |
| Present | E | 3.16 | 0.025 | 0.34 | 0.058 | 0.025 | 0.0005 | 0.0035 | 0.006 | 0.015 | 0.018 | 49.4 | 10.5% | 0.023 | 0.35 | 17% |
| Invention | F | 3.26 | 0.024 | 0.34 | 0.065 | 0.024 | 0.0006 | 0.0031 | 0.006 | 0.024 | 0.027 | 50.4 | 7.6% | 0.022 | 0.36 | 18% |
| | G | 3.25 | 0.024 | 0.34 | 0.060 | 0.024 | 0.0006 | 0.0031 | 0.004 | 0.018 | 0.020 | 50.0 | 8.6% | 0.023 | 0.35 | 17% |

Table II and FIG. 1 summarize the results which show the improved toughness and lower ductile-to-brittle transition characteristics provided in the hot processed strip of the inventive electrical steel versus an electrical steel of the prior art.

TABLE II

Impact Energy Measurements for Prior Art Grain Oriented Electrical Steel and Grain Oriented Electrical Steel of Present Invention vs. Temperature

| Test Temperature | Impact Energy (J/mm2) Steel of Prior Art | | | | Impact Energy (J/mm2) Steel of Invention | | | | |
|---|---|---|---|---|---|---|---|---|---|
| °C. | A | B | C | Ave. | D | E | F | G | Ave. |
| 24 | 0.068 | 0.062 | 0.043 | 0.058 | 0.130 | 0.061 | 0.142 | 0.082 | 0.104 |
| 38 | 0.084 | 0.074 | 0.074 | 0.078 | | | | | |
| 66 | 0.087 | 0.105 | 0.106 | 0.099 | 0.265 | 0.162 | 0.174 | 0.161 | 0.190 |

TABLE II-continued

Impact Energy Measurements for Prior Art Grain Oriented Electrical Steel and Grain Oriented Electrical Steel of Present Invention vs. Temperature

| Test Temperature | Impact Energy (J/mm2) Steel of Prior Art | | | | Impact Energy (J/mm2) Steel of Invention | | | | |
|---|---|---|---|---|---|---|---|---|---|
| °C. | A | B | C | Ave. | D | E | F | G | Ave. |
| 93 | 0.087 | 0.112 | 0.157 | 0.119 | | | | | |
| 121 | 0.368 | 0.292 | 0.272 | 0.311 | 0.522 | 0.294 | 0.585 | 0.352 | 0.438 |
| 149 | 0.931 | 0.387 | 0.656 | 0.658 | 0.698 | 0.578 | 0.604 | 0.500 | 0.595 |
| 204 | | | | | 0.867 | 0.671 | 0.782 | 0.751 | 0.768 |
| 232 | | | | | 1.006 | 0.855 | 0.933 | 0.894 | 0.922 |

Example 2

The hot processed strips from Melts D through G of Example I were processed along with melts of the prior art whose compositions are shown in Table III.

TABLE III

Summary of Compositions of Grain Oriented Electrical Steels

| | ID | Si | C | Cr | Mn | S | Al | N | Sn | excess Mn | excess Mn+ 0.46 Sn | ρ | % γ @CR1 | % C @CR1 | I | I/t |
|---|---|---|---|---|---|---|---|---|---|---|---|---|---|---|---|---|
| Prior | H | 3.42 | 0.031 | 0.09 | 0.060 | 0.023 | 0.0008 | 0.0029 | 0.007 | 0.020 | 0.026 | 50.4 | 4.6% | 0.025 | 0.34 | 17% |
| Art | I | 3.39 | 0.031 | 0.13 | 0.058 | 0.023 | 0.0006 | 0.0037 | 0.006 | 0.020 | 0.022 | 50.3 | 6.3% | 0.026 | 0.33 | 16% |
| | J | 3.40 | 0.031 | 0.22 | 0.058 | 0.022 | 0.0008 | 0.0036 | 0.008 | 0.020 | 0.024 | 51.1 | 7.0% | 0.027 | 0.31 | 15% |
| | K | 3.43 | 0.031 | 0.26 | 0.059 | 0.023 | 0.0009 | 0.0039 | 0.008 | 0.020 | 0.024 | 51.8 | 7.0% | 0.027 | 0.30 | 14% |

The materials were processed in trials wherein the hot processed strips from Melts D through G were annealed at 1065° C. for a time of from 5–15 seconds in a mildly oxidizing anneal while the hot processed strips from Melts H through K were similarly annealed at 1010° C. After pickling, the annealed strips were cold rolled to intermediate thicknesses of from 0.58–0.61 mm, intermediate annealed at 920°–950° C. for 5–25 seconds and cold rolled to a final thicknesses of 0.18–0.21 mm. After completing cold rolling, the strips were decarburization annealed at 860° –870° C. in a wet hydrogen-nitrogen atmosphere, coated with a magnesia separator and given a final anneal at 1200° C. for over 10 hours in dry hydrogen. The resulting magnetic quality obtained in these trials is summarized in Table IV.

TABLE IV

Summary of Magnetic Quality at 0.18 mm Thickness

| | ID | ρ | Properties at 0.18 mm Thickness: Core loss 1.5 T 60 Hz (W/kg) | Properties at 0.18 mm Thickness: Permeability at H = 796 A/m | Properties at 0.21 mm Thickness: Core loss 1.5 T 60 Hz (W.kg) | Properties at 0.21 mm Thickness: Permeability at H = 796 A/m |
|---|---|---|---|---|---|---|
| Alloy of Invention | D | 50.2 | 0.82 | 1838 | 0.86 | 1846 |
| | E | 49.4 | 0.82 | 1842 | 0.87 | 1847 |
| | F | 50.4 | 0.81 | 1838 | 0.86 | 1841 |
| | G | 50.0 | 0.82 | 1837 | 0.87 | 1842 |
| Prior Art | H | 50.4 | — | — | 0.87 | 1841 |
| | I | 50.3 | — | — | 0.88 | 1843 |
| | J | 51.1 | — | — | 0.88 | 1830 |
| | K | 51.8 | — | — | 0.92 | 1811 |

The magnetic permeability measured at 796 A/m and core losses measured at 1.5 T 60 Hz in Table IV show the magnetic properties obtained on Melts D through G of the present invention and Melt H of the prior art method compare favorably. However, Melts I through K of the prior art which have chromium compositions significantly above 0.1% evidenced lower magnetic permeability and higher core losses. The excellent results obtained on Melts E through G using a chromium composition of 0.33–0.34% is provided by the method of the present invention wherein the appropriate compositions of carbon, chromium, silicon and other elements incident to the method of steelmaking are properly balanced to provide superior permeability and low and very consistent core losses.

Example 3

Four melts which compositions are shown in Table V were melted in the trial by the method of the present invention containing about 3.25% silicon and about 0.20% to 0.25% chromium with a balance of iron and normal residual elements such as boron of 0.0005% or less, molybdenum of 0.06% or less, nickel of 0.15% or less, phosphorus of less than 0.020% or less, and aluminum of 0.005% or less. Both methods provided a volume resistivity (ρ) of about 50 to 51 μΩ-cm, an austenite volume fraction ($\gamma_{1150°\ C.}$) of about 5–6% and an isometric layer of thickness (I) of 0.34 to 0.36 mm.

TABLE VI

Summary of Magnetic Quality at 0.21 mm Thickness

| | ID | ρ | Properties at 0.21 mm Thickness: Core loss at 1.5T 60 Hz (W/kg) | Properties at 0.21 mm Thickness: Permeability at H = 796 A/m |
|---|---|---|---|---|
| Alloy of Invention | L | 50.2 | 0.86 | 1846 |
| | M | 49.4 | 0.87 | 1847 |
| | N | 50.4 | 0.86 | 1841 |
| | O | 50.0 | 0.87 | 1842 |

In the present invention, the compositions of carbon, silicon and chromium were appropriate to provide the desired characteristics needed for vigorous secondary grain growth and excellent magnetic quality.

Example 4

Two melts having very low carbon compositions of the prior art and the present invention are shown in Table VII. The melt of the present invention contained 3.15% silicon and 0.3% chromium with a balance of iron and normal residual elements such as boron of 0.0005% or less, molybdenum of 0.06% or less, nickel of 0.15% or less, phosphorus of 0.020% or less, and aluminum of 0.005% or less which provided a composition of volume resistivity (ρ) of about 50 μΩ-cm. The austenite volume fraction (γ1150° C.) of prior art melt P was less than 2% and the austenite volume fraction of melt Q of this invention was about 5.6 %.

TABLE V

Summary of Compositions of Grain Oriented Electrical Steels

| | ID | Si | C | Cr | Mn | S | Al | N | Sn | excess Mn | excess Mn+ 0.46 Sn | ρ | % γ @CR1 | % C @CR1 | I | I/t |
|---|---|---|---|---|---|---|---|---|---|---|---|---|---|---|---|---|
| Present Invention | L | 3.35 | 0.027 | 0.21 | 0.059 | 0.023 | 0.0009 | 0.0040 | 0.007 | 0.020 | 0.023 | 50.5 | 6.2% | 0.024 | 0.34 | 17% |
| | M | 3.35 | 0.026 | 0.21 | 0.061 | 0.023 | 0.0009 | 0.0036 | 0.006 | 0.025 | 0.028 | 50.5 | 4.9% | 0.023 | 0.36 | 18% |
| | N | 3.38 | 0.026 | 0.25 | 0.060 | 0.024 | 0.0007 | 0.0036 | 0.007 | 0.019 | 0.022 | 51.0 | 5.2% | 0.023 | 0.34 | 17% |
| | O | 3.35 | 0.025 | 0.25 | 0.059 | 0.022 | 0.0007 | 0.0038 | 0.005 | 0.021 | 0.023 | 50.7 | 5.6% | 0.023 | 0.35 | 17% |

The starting strips from Melts L through 0 were processed in the trim to a final thickness of 0.21 mm in accordance with the procedure of Example 2. The resulting magnetic quality obtained in these trials is summarized in Table VI.

TABLE VII

Summary of Compositions of Grain Oriented Electrical Steels

| | ID | Si | C | Cr | Mn | S | Al | N | Sn | excess Mn | excess Mn+ 0.46 Sn | ρ | % γ @CR1 | % C @CR1 | I | I/t |
|---|---|---|---|---|---|---|---|---|---|---|---|---|---|---|---|---|
| Prior Art | P | 3.42 | 0.022 | 0.07 | 0.060 | 0.022 | 0.0007 | 0.0043 | 0.007 | 0.022 | 0.0253 | 50.4 | <2.0% | 0.018 | 0.40 | 20% |
| Alloy of Invention | Q | 3.17 | 0.018 | 0.32 | 0.051 | 0.024 | 0.0007 | 0.0040 | 0.007 | 0.010 | 0.0134 | 49.3 | 5.6% | 0.016 | 0.41 | 20% |

Both melts were processed in accordance with the procedures of Example 2 with the following exceptions. Melt Q was processed to a final thickness of 0.26 mm using an intermediate thickness of 0.66 mm. The composition of carbon in the melts was lower than typical of the prior art; however, Melt Q of the present invention is provided with compositions of silicon and chromium appropriate for vigorous secondary grain growth. Melt P had low austenite percentage which is not conducive to the type of stable secondary grain growth needed to achieve a high quality cube-on-edge orientation. As a result, Melt P was processed to a less critical final thickness of 0.35 mm using an intermediate thickness of 0.8 mm. The resulting magnetic quality obtained in these trials is summarized in Table VIII.

TABLE VIII

Summary of Magnetic Quality at 0.26 mm and 0.35 mm Thickness

| | | | Properties at 0.26 mm Thickness | | Properties at 0.35 mm Thickness | |
|---|---|---|---|---|---|---|
| | ID | ρ | Core loss 1.7 T 60 Hz (W/kg) | Permeability at H = 796 A/m | Core loss 1.7 T 60 Hz (W/kg) | Permeability at H = 796 A/m |
| Prior Art | P | 50.4 | — | — | 1.87 | 1810 |
| Present Invention | Q | 49.3 | 1.51 | 1838 | — | — |

The magnetic permeability measured at 796 A/m and core loss measured at 1.5 T 60 Hz in Table VIII show that excellent magnetic properties with Melt Q of the present invention in spite of the low percentage of carbon while Melt P of the prior art produced marginal magnetic properties as would be expected from a grain oriented electrical steel of the prior art methods having very low carbon compositions.

TABLE IX

Summary of Compositions of Grain Oriented Electrical Steels

| | ID | Si | C | Cr | Mn | S | Al | N | Sn | excess Mn | excess Mn+ 0.46 Sn | ρ | % γ @CR1 | % C @CR1 | I | I/t |
|---|---|---|---|---|---|---|---|---|---|---|---|---|---|---|---|---|
| Prior Art | R | 3.74 | 0.040 | 0.05 | 0.055 | 0.024 | 0.0006 | 0.0038 | 0.009 | 0.014 | 0.0181 | 53.7 | 2.1% | 0.032 | 0.25 | 13% |
| | S | 3.65 | 0.039 | 0.07 | 0.064 | 0.022 | 0.0010 | 0.0028 | 0.010 | 0.026 | 0.0302 | 55.1 | 5.2% | 0.032 | 0.24 | 12% |
| Present | T | 3.15 | 0.010 | 1.00 | 0.060 | 0.025 | 0.0010 | 0.0040 | 0.005 | 0.017 | 0.0195 | 53.5 | 5.0% | 0.010 | 0.43 | 21% |
| Invention | U | 3.35 | 0.015 | 1.20 | 0.060 | 0.025 | 0.0010 | 0.0040 | 0.005 | 0.017 | 0.0195 | 56.9 | 5.0% | 0.015 | 0.36 | 18% |

Example 5

Trials of a grain oriented electrical steel of the prior art were conducted to further increase the volume resistivity to above 53 μΩ-cm by raising the silicon to a composition above 3.5%. However, the carbon composition needed to provide the necessary amount of austenite before cold rolling resulted in a thinner surface isomorphic layer and, thereby, less vigorous secondary grain growth. Table IX summarizes the melt chemistries and microstructural results from these prior art melts. Melts R and S of the prior art method were processed to a final thickness of 0.21 mm in accordance with the procedures of Example 2 and produced inconsistent and mediocre magnetic quality with magnetic permeability at H=796 A/m ranging from 1799–1831 and 1.5 T 60 Hz core losses ranging from 0.87–0.91 W/kg. In these trials, the process was evidencing increasingly unstable secondary grain growth believed to have resulted from the very thin isomorphic layer thickness. Further, the mechanical properties were degraded, reflected in poorer toughness and a higher ductile-to-brittle transition temperature.

It is believed that the alloy composition of the present invention can provide a grain oriented electrical steel with a high level of volume resistivity and stable secondary grain growth owing to the provision of an appropriately thick isomorphic layer with an appropriate austenite volume fraction. It is further believed the grain oriented electrical steel of the present invention would also provide superior physical properties.

The preferred embodiments discussed herein have demonstrated a grain oriented electrical steel with low core losses can be made using the chromium-silicon alloy of the present invention and at least two cold reductions to provide a consistent and excellent composition of magnetic quality comparing favorably with the silicon-iron alloys of the prior art. The present invention may also employ a strip which has been produced using methods such as ingot casting, thick slab casting, thin slab casting, strip casting or other methods of compact strip production.

It will be understood various modifications may be made to the invention without departing from the spirit and scope of it. Therefore, the limits of the invention should be determined from the appended claims.

What is claimed is:

1. A method for producing a grain oriented electrical steel having superior magnetic properties, comprising the steps of:

providing a hot processed strip having an austenite volume fraction and an isomorphic layer on each surface of the strip, the strip consisting essentially of 2.5–4.5% silicon, 0.1–1.2% chromium, less than 0.050% carbon, less than 0.005% aluminum, up to 0.1% sulfur, up to 0.14% selenium, 0.01–1% manganese and balance being essentially iron and residual elements, the strip having a volume resistivity of at least 45 μΩ-cm, at least 0.010% carbon so that the austenite volume fraction is at least 2.5% and each isomorphic layer having a thickness of at least 10% of the total thickness of the hot processed strip, cold rolling the strip to an intermediate thickness, annealing the cold reduced strip, cold rolling the annealed strip to a final thickness, decarburize annealing the cold reduced strip to sufficiently to prevent magnetic aging, coating at least one surface of the annealed strip with an annealing separator coating, and final annealing the coated strip to effect secondary grain growth and thereby provide a permeability measured at 796 A/m of at least 1780.

2. The method claimed of claim 1 wherein the isomorphic layer on each surface has a thickness of 15–40% of the total thickness of the hot processed strip.

3. The method claimed of claim 1 wherein the isomorphic layer on each surface has a thickness of 20–35% of the total thickness of the hot processed strip.

4. The method claimed in claim 1 wherein a microstructure of the strip prior to the cold rolling to the final thickness consists of fine iron carbide precipitates in a ferrite matrix having less than 1 vol. % of martensite and/or retained austenite.

5. The method claimed in claim 4 wherein the annealed strip before the cold rolling to final thickness is slowly cooled at a rate of no greater than 10° C. per second to 650° C. and thereafter rapidly cooled at a rate of at least 23° C. per second to about 315° C.

6.The method claimed of claim 1 wherein the strip is annealed before the cold rolling to the intermediate thickness at a temperature of 750–1150° C. for a time up to 10 minutes and slow cooling the strip to a temperature less than 500° C.

7. The method claimed of claim 6 wherein a microstructure of the strip prior to the cold rolling to the final thickness consists of fine iron carbide precipitates in a ferrite matrix having less than 1 vol. % of martensite and/or retained austenite and the strip prior to the cold rolling to the final thickness has at least 0.010% carbon.

8. The method claimed of claim 1 wherein the volume resistivity is at least 50 μΩ-cm.

9. The method claimed of claim 1 wherein the carbon is no greater than 0.03% so that the austenite volume fraction is no greater than 10.0%.

10. The method claimed of claim 1 wherein the chromium is 0.2–0.6%.

11. The method claimed of claim 1 wherein the manganese is 0.05–0.07% and the sulfur is 0.02-0.03%.

12. The method claimed of claim 1 wherein the silicon is 2.9–3.8%.

13. The method claimed of claim 1 wherein the decarburized strip has less than 0.003% carbon.

14. The method claimed of claim 1 wherein the strip is intermediate annealed before cold rolling to the final strip thickness at a temperature of at least 800° C. for at least 5 seconds.

15. The method claimed of claim 1, wherein the strip is decarburized annealed after cold rolling to the final strip thickness at a temperature of at least 800° C. for at least 5 seconds.

16. The method claimed of claim 1 wherein the strip is final annealed at a temperature of at least 1100 ° C. for at least 5 hours.

17. The method claimed of claim 16 wherein the strip is final annealed at a temperature of at least 1200° C. for at least 20 hours.

18. The method claimed of claim 1 wherein the thickness of the hot processed strip is 1.7–3.0 mm.

19. A method for producing a grain oriented electrical steel having superior magnetic properties, comprising the steps of:

providing a hot processed strip having a thickness of 1.5–4.0 mm, an austenite volume fraction and an isomorphic layer on each surface of the strip, the strip consisting essentially of 2.5–4.5% silicon, 0.1–1.2% chromium, no greater than 0.030% carbon, less than 0.005% aluminum, up to 0.1% sulfur, up to 0.14% selenium, 0.01–1% manganese and balance being essentially iron and residual elements, the strip having a volume resistivity of at least 45 μΩ-cm and each isomorphic layer having a thickness of 10–40% of the total thickness of the hot processed strip, annealing the strip at a temperature of at least 800° C., the annealed strip having at least 0.010% carbon so that the austenite volume fraction is 2.5–10.0%, cold rolling the strip to an intermediate thickness, annealing the cold reduced strip wherein a microstructure of the strip consists of fine iron carbide precipitates in a ferrite matrix having less than 1 vol. % of martensite and/or retained austenite, cold rolling the annealed strip to a final thickness, decarburize annealing the cold reduced strip to sufficiently to prevent magnetic aging, coating at least one surface of the annealed strip with an annealing separator, and final annealing the coated strip to effect secondary grain growth and thereby provide a permeability measured at 796 A/m of at least 1780.

20. A method for producing a grain oriented electrical steel having superior magnetic properties, comprising the steps of:

providing a strip having a hot processed thickness of 1.7–3.0 mm, an austenite volume fraction and an isomorphic layer on each surface of the strip, the strip consisting essentially of 2.9–3.8% silicon, 0.2–0.7% chromium, no greater than 0.030% carbon, less than 0.005% aluminum, 0.020–0.030% sulfur, 0.015–0.05% selenium, 0.05–0.07% manganese and balance being essentially iron and residual elements, annealing the hot processed strip at a temperature of 1000–1125° C. for a time up to 10 minutes, the annealed strip having a volume resistivity of at least 50 μΩ-cm, at least 0.010% carbon so that the austenite volume fraction is 4.0–10.0% and the isomorphic layer on each surface having a thickness of 0.17–1.20 mm, cold rolling the strip to an intermediate thickness, annealing the cold reduced strip at a temperature of at least 800° C. for at least 5 seconds and slowly cooling the strip at a rate of no greater than 10° C. per second to 650° C. and thereafter rapidly cooling at a rate of at least 23° C. per second to about 315° C. whereby a microstructure of the strip consists of fine iron carbide precipitates in a ferrite matrix having less than 1 vol. % of martensite and/or retained austenite, cold rolling the annealed strip to a final thickness, decarburize annealing the cold reduced strip to less than 0.003% carbon, coating at least one surface of the annealed strip with an annealing separator, and final annealing the coated strip at a temperature of at least 1100° C. for at least 5 hours to effect secondary grain growth and thereby provide a permeability measured at 796 A/m of at least 1780.

* * * * *